US007070089B2

(12) United States Patent
Kim et al.

(10) Patent No.: US 7,070,089 B2
(45) Date of Patent: Jul. 4, 2006

(54) MULTI-DIMENSIONED EASILY ADJUSTABLE SINGLE SHEET CONTAINER FORMULA WITH INDICIA

(76) Inventors: Richard H. Kim, 1450 S. Havana St. Suite 312, Aurora, CO (US) 80012; Bobby Kim, 1450 S. Havana St. Suite 312, Aurora, CO (US) 80012; Susie Y. Kim, 1450 S. Havana St. Suite 312, Aurora, CO (US) 80012; Debra Y. Kim, 1450 S. Havana St. Suite 312, Aurora, CO (US) 80012

( * ) Notice: Subject to any disclaimer, the term of this patent is extended or adjusted under 35 U.S.C. 154(b) by 0 days.

(21) Appl. No.: 10/774,792

(22) Filed: Feb. 9, 2004

(65) Prior Publication Data

US 2005/0173502 A1 Aug. 11, 2005

(51) Int. Cl.
*B65D 5/42* (2006.01)

(52) U.S. Cl. ..... 229/101; 206/459.5

(58) Field of Classification Search ..... 229/101, 229/101.1, 101.2; 206/459.5; 428/43
See application file for complete search history.

(56) References Cited

U.S. PATENT DOCUMENTS 2,692,599 A * 10/1954 Creelman ..... 206/459.5
3,313,467 A * 4/1967 Anderskow et al. ..... 229/101
3,598,303 A * 8/1971 Folz ..... 229/101
3,672,558 A * 6/1972 Johnson ..... 229/101
3,727,827 A * 4/1973 Stice ..... 229/101
4,136,817 A * 1/1979 Perry ..... 229/101
4,763,831 A * 8/1988 Huang et al. ..... 229/101
5,060,849 A * 10/1991 King ..... 229/101
6,138,901 A 10/2000 Kim et al.
6,279,818 B1 8/2001 Kim et al.

FOREIGN PATENT DOCUMENTS

EP 97022 A1 * 12/1983 ..... 229/101
GB 1029562 * 5/1966 ..... 229/101
GB 2221896 A * 2/1990 ..... 229/101

* cited by examiner

*Primary Examiner*—Gary E. Elkins
(74) *Attorney, Agent, or Firm*—Barber Legal; Craig Barber

(57) ABSTRACT

A multidimensional and easily adjusted container may be created from a single sheet container template having a plurality of horizontal and vertical fold lines and perforation lines extending along portions of the fold lines. A large number of containers having a variety of dimensions may be created by using indicia such as numbering of the fold lines and perforation lines, instructions and so on to indicate to users how to fold the box into various sizes and shapes. A unit dimension of the separation of the parallel lines may provide a regular grid of lines, or the separation distance between parallel lines may be a multiple of the unit distance. Different multiples of the unit distance may be used on a single container template, and the unit distance may be different for the horizontal and vertical fold lines.

15 Claims, 14 Drawing Sheets

2 BOX DESIGN

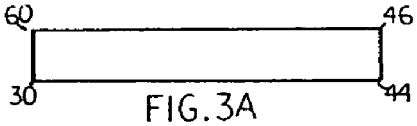
FIG. 3A
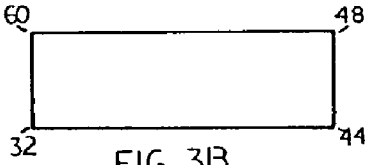
FIG. 3B
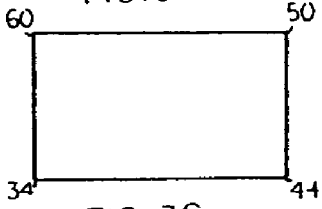
FIG. 3C
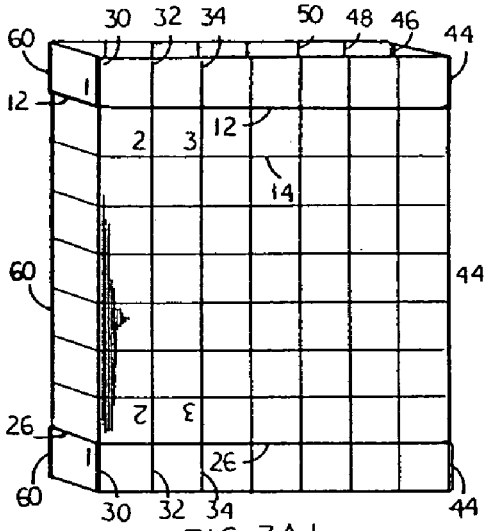
FIG. 3A1
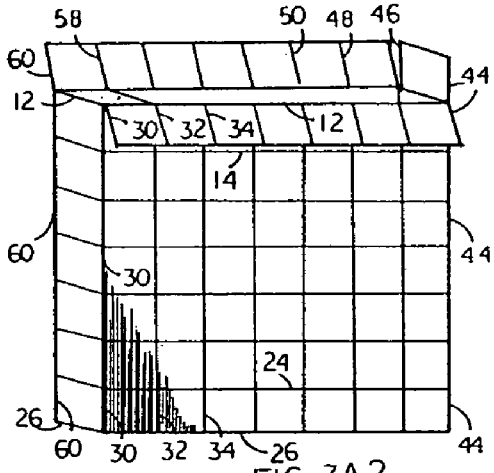
FIG. 3A2
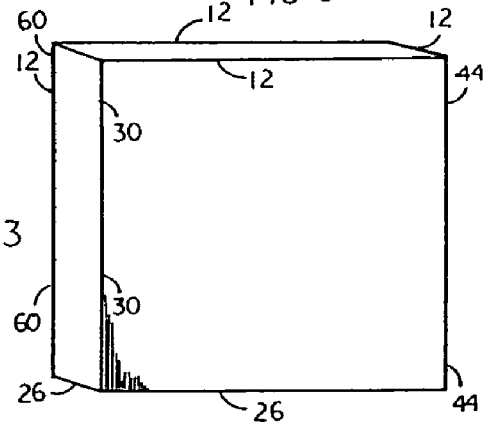
FIG. 3A3

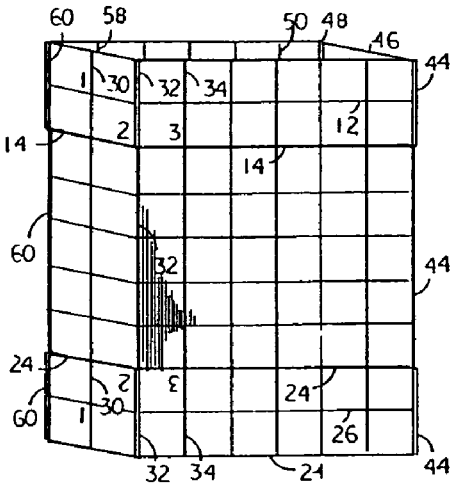
FIG. 3B1
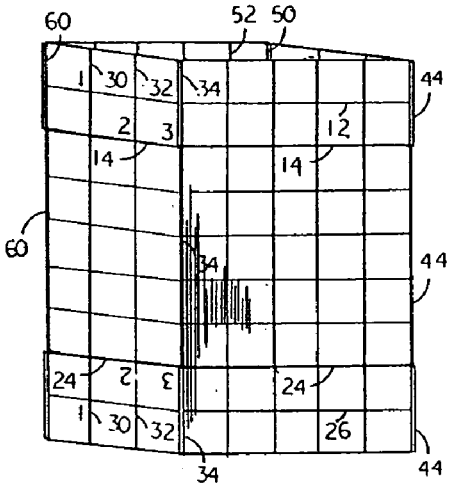
FIG. 3C1
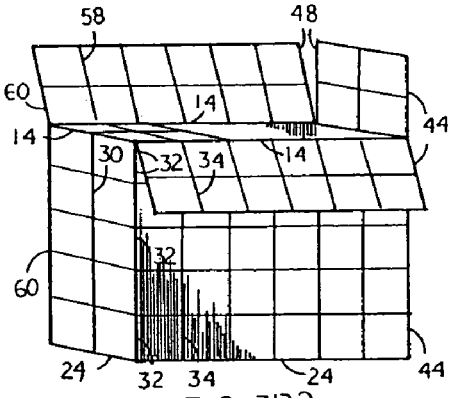
FIG. 3B2
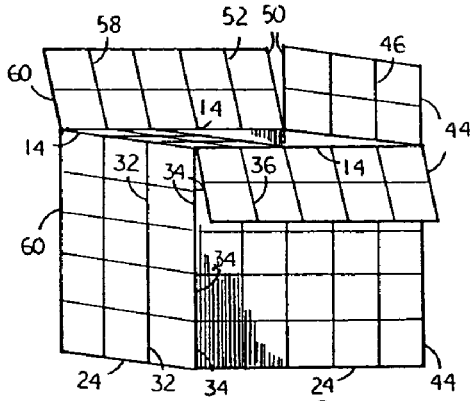
FIG. 3C2
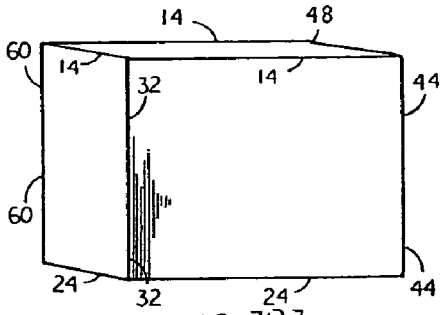
FIG. 3B3
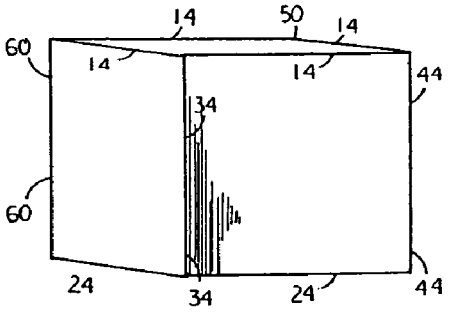
FIG. 3C3

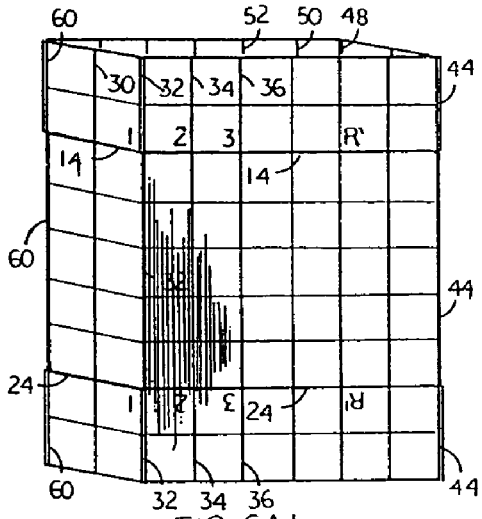
FIG·6A1
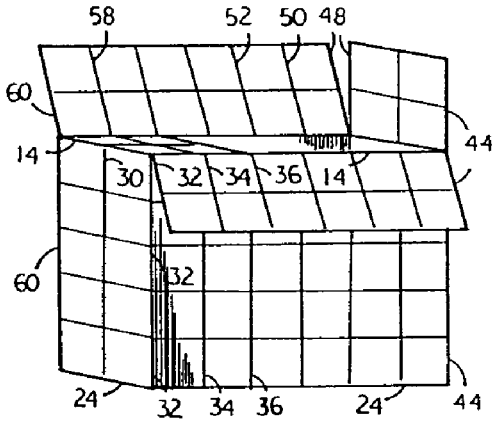
FIG·6A2
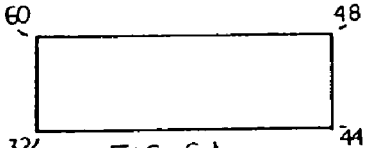
FIG·6A
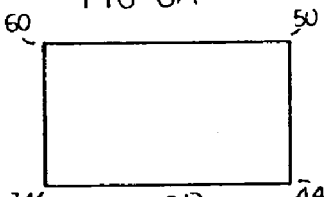
FIG·6B
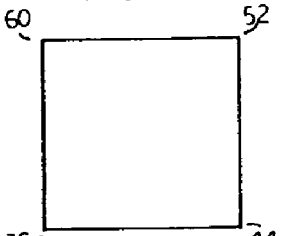
FIG·6C
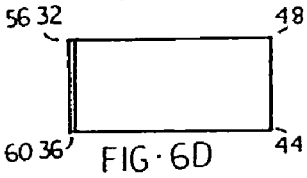
FIG·6D
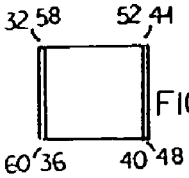
FIG·6E
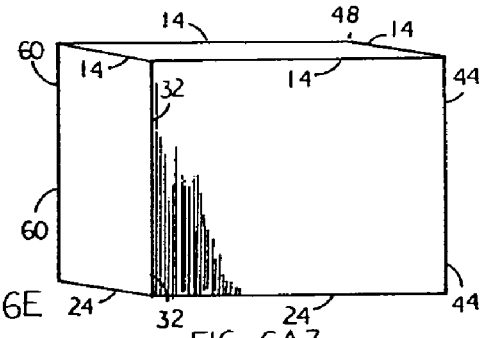
FIG·6A3

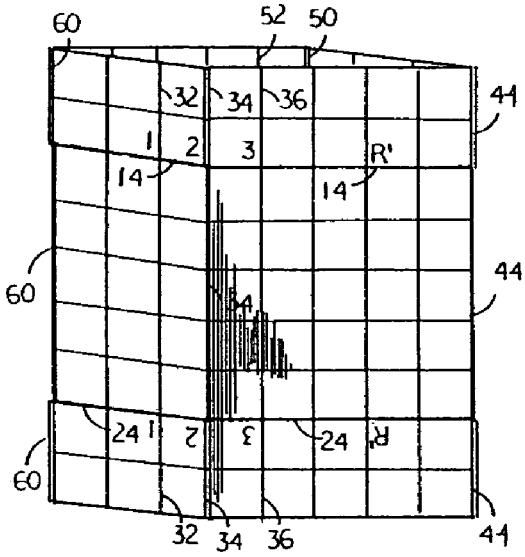
FIG·6B1
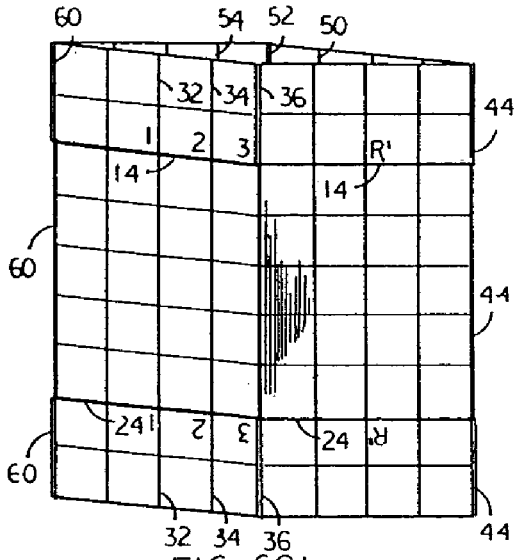
FIG·6C1
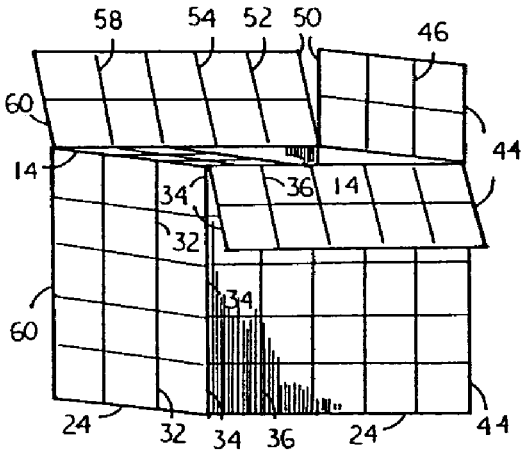
FIG·6B2
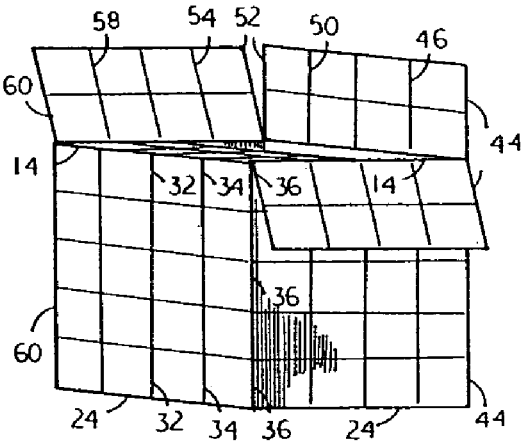
FIG·6C2
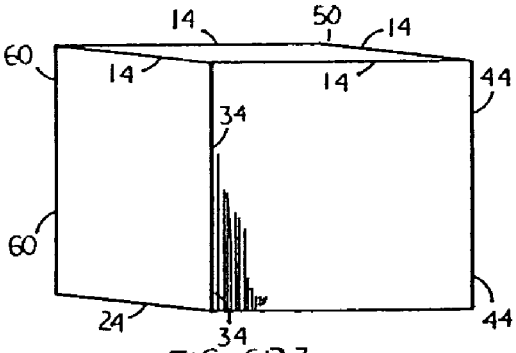
FIG·6B3
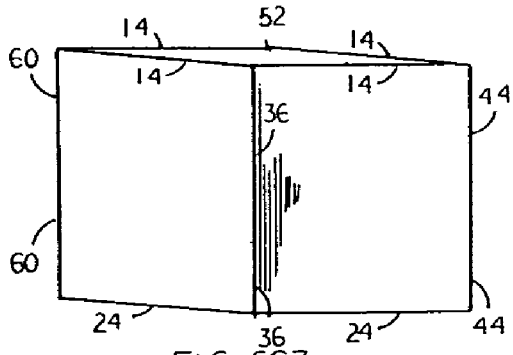
FIG·6C3

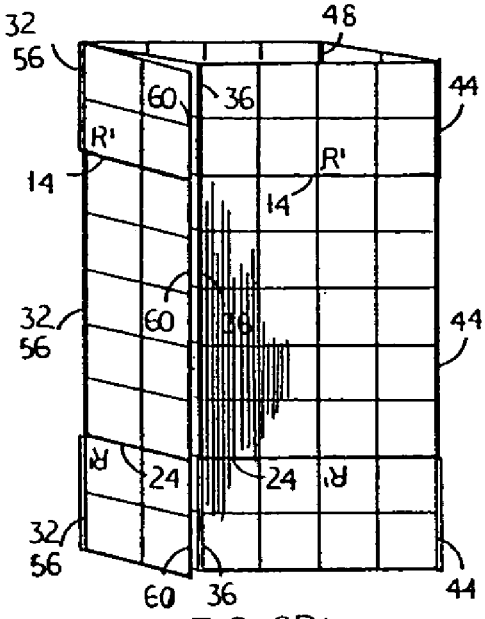
FIG·6D1
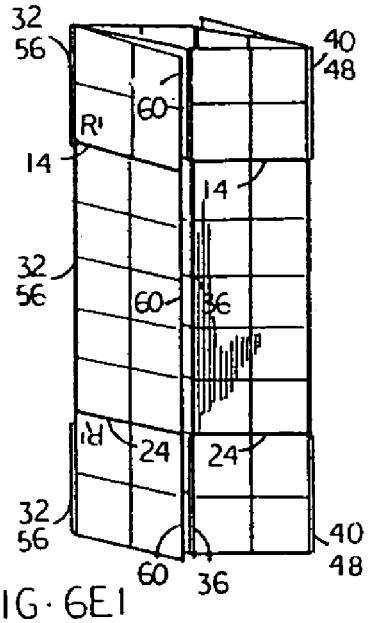
FIG·6E1
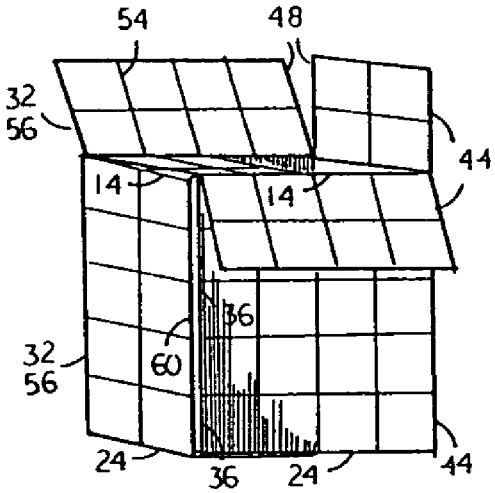
FIG·6D2
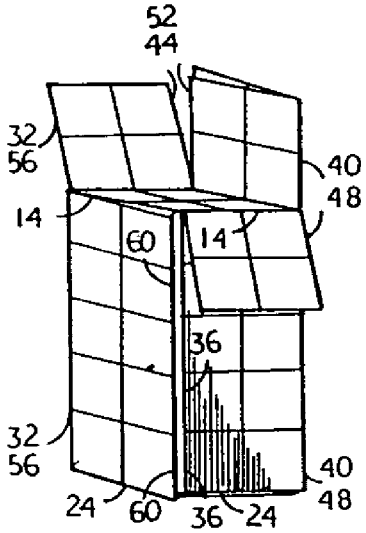
FIG·6E2
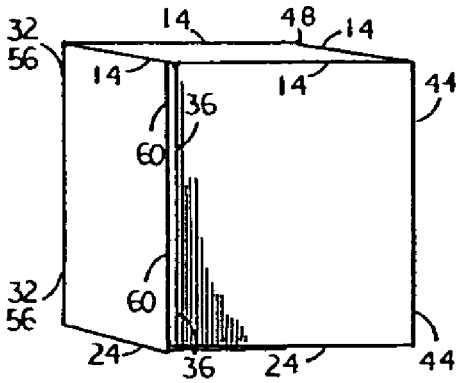
FIG·6D3
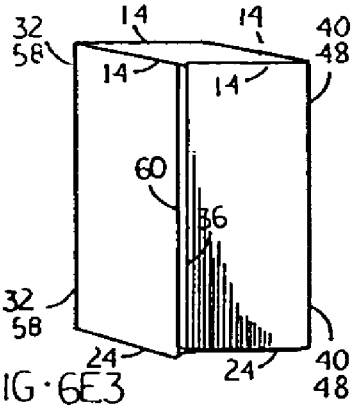
FIG·6E3

14 BOX DESIGN

25 BOX DESIGN

MULTI-DIMENSIONED EASILY ADJUSTABLE SINGLE SHEET CONTAINER FORMULA WITH INDICIA

FIELD OF THE INVENTION

This invention relates generally to containers and specifically to a template or formula for single sheet multi-dimensioned containers allowing creation of various sizes and dimensions of boxes from a single sheet of material.

CROSS-REFERENCE TO RELATED APPLICATIONS

N/A.

STATEMENT REGARDING FEDERALLY FUNDED RESEARCH

This invention was not made under contract with an agency of the U.S. Government, nor by any agency of the U.S. Government.

BACKGROUND OF THE INVENTION

In creating folded cardboard boxes and similar containers, it has been learned that a wide range of dimensions of the containers are beneficial. The problem with maintaining wide ranges of containers in the competitive and commodity cardboard box industry, however, is that each unit is a relatively low cost and low margin product. Designing, distributing and stocking very large ranges of box devices is simply impractical. Thus most shipping and packing stores stock a scant dozen or so sizes.

Typically, shipping and storage containers come in limited sizes and shapes with integration of multiple pieces often required. This results in larger-than-necessary containers being utilized with the excess interior space being absorbed by filler material.

It is desirable, therefore, to have an adjustable shipping container that is capable of accommodating a variety of different sized items without having to add additional pieces.

One solution to this problem which has been noted previously is the multiple size box: a single sheet which may be folded to create more than one dimension of box. However, designing each combination of device may be quite complex, and the result is likely to be a design which makes only two or three dimensions of boxes.

It would be advantageous to provide a broader TEMPLATE of box blanks. Such a template would allow the creation of numerous embodiments in which each embodiment in turn could be used to produce a number of boxes having differing dimensions selected by the end user to suit their particular and momentary shipping or packing needs.

Two items in particular may be pointed out. U.S. Pat. No. 6,279,818 issued Aug. 28, 2001 to the same inventors as are named in the present patent application (Richard H. Kim, Bobby Kim, Susie Y. Kim, Debra Y. Kim, see title page and list of inventors above) teaches a first design for a multi dimension box.

U.S. Pat. No. 6,138,901 issued Oct. 31, 2000, and also to the inventors present herein (Richard H. Kim, Bobby Kim, Susie Y. Kim, Debra Y. Kim, see enclosed oath) teaches a second design for a multidimensional box.

Yet another problem occurs when a template for production of more than one or two containers is invented. In particular, it has been learned that correctly folding such a box template to the proper size and shape can be quite challenging due to the proliferation in the number of fold lines. Worse, as the number of perforation lines increases, it becomes ever more likely that an excess perforation or misplaced perforation will be made. While a good box design provides a strong container even when it has excess perforations, it is obviously almost a commercial necessity to provide end users with a clear and efficient method of folding the single sheet container blank (embodiment) based upon the generalized template into the desired final choice of box.

It would be advantageous to provide a box which allows users to easily select and easily adjust the blank to create the desired dimension of box.

SUMMARY OF THE INVENTION

General Summary

A template is provided, which with appropriate indicia and perforation lines along known fold lines may be used to create a number of blanks. Each of the blanks may in turn be used to create a plurality of different box dimensions.

A multidimensional and easily adjusted container may be created from a single sheet container template having a plurality of horizontal and vertical fold lines and perforation lines extending along portions of the fold lines. A large number of containers having a variety of dimensions may be created by using indicia such as numbering of the fold lines and perforation lines, instructions and so on to indicate to users how to fold the box into various sizes and shapes. A unit dimension of the separation of the parallel lines may provide a regular grid of lines, or the separation distance between parallel lines may be a multiple of the unit distance. Different multiples of the unit distance may be used on a single container template, and the unit distance may be different for the horizontal and vertical fold lines.

Summary in Reference to Prototypical Claim

It is therefore yet another aspect, advantage, objective and embodiment to provide a multi dimensioned easily adjustable single sheet container template indicia for folding into variously dimensioned containers for shipping and storage, the template comprising: a single rectangular sheet of packaging material; the single rectangular sheet having a plurality of vertical fold lines; the single rectangular sheet having a plurality of horizontal fold lines; the single rectangular sheet being divided into a plurality of panels by the vertical and horizontal fold lines; each panel connected to adjoining panels at the fold lines; a plurality of perforation lines, each perforation line extending along at least one side of at least one pane, each perforation line colinear with at least one fold line; 1) a first set of indicia of a first subset of the plurality of fold lines and perforation lines, the single rectangular sheet when folded and perforated according to the first set of indicia becoming a first one of a plurality of differently dimensioned containers; and 2) a second set of indicia of a second subset of the plurality of fold lines and perforation lines, the single rectangular sheet when folded and perforated according to the second set of indicia becoming a second one of the plurality of differently dimensioned containers; and 3) a third set of indicia of a third subset of the plurality of fold lines and perforation lines, the single rectangular sheet when folded and perforated according to the third set of indicia becoming a third one of the plurality of differently dimensioned containers.

It is therefore yet another aspect, advantage, objective and embodiment to provide a multidimensioned easily adjustable single sheet container template further comprising:

fourth and fifth sets of indicia allowing folding and perforating into respective fourth and fifth ones of the plurality of differently dimensioned containers.

It is therefore another aspect, advantage, objective and embodiment to provide a multidimensioned easily adjustable single sheet container template further comprising: sixth through twenty-fifth sets of indicia allowing folding and perforating into respective sixth through twenty fifth ones of the plurality of differently dimensioned containers.

It is therefore yet another aspect, advantage, objective and embodiment to provide a multidimensioned easily adjustable single sheet container template wherein the indicia further comprise: numbered designators of each of the plurality of fold lines and perforation lines.

It is therefore yet another aspect, advantage, objective and embodiment to provide a multidimensioned easily adjustable single sheet container template wherein the indicia further comprise: lettered designators of each of the plurality of fold lines and perforation lines.

It is therefore yet another aspect, advantage, objective and embodiment to provide a multidimensioned easily adjustable single sheet container template wherein the indicia further comprise: instructions indicating the steps to take to fold the container template into each of the plurality of differently dimensioned containers.

It is therefore yet another aspect, advantage, objective and embodiment to provide a multidimensioned easily adjustable single sheet container template wherein the indicia further comprise: diagrams indicating the steps to take to fold the container template into each of the plurality of differently dimensioned containers.

It is therefore yet another aspect, advantage, objective and embodiment to provide a multidimensioned easily adjustable single sheet container template wherein the indicia further provide instruction as to whether a given one of the plurality of fold lines is to be folded positively (mount folded) or negatively (valley folded).

It is therefore yet another aspect, advantage, objective and embodiment to provide a multidimensioned easily adjustable single sheet container template wherein the indicia further provide instruction as to the length of a given perforation line which is to be cut at the time of folding.

It is therefore yet another aspect, advantage, objective and embodiment to provide a multidimensioned easily adjustable single sheet container template wherein the material of the container template is one member selected from the group consisting of: single ply cardboard, multi-ply cardboard, corrugated cardboard, polymer, metal, composite materials, and combinations thereof.

It is therefore yet another aspect, advantage, objective and embodiment to provide a multidimensioned easily adjustable single sheet container template further comprising: a first unit distance, wherein each fold line is separated from the next parallel fold line by an integer multiple of the first unit distance, whereby each panel has dimensions which are also an integer multiple of the first unit distance.

It is therefore yet another aspect, advantage, objective and embodiment to provide a multidimensioned easily adjustable single sheet container template wherein the integer multiple is one for every fold line of the container template, whereby each panel has dimensions which are the first unit distance.

It is therefore yet another aspect, advantage, objective and embodiment to provide a multidimensioned easily adjustable single sheet container template wherein there are at least two integer multiples of the first unit distance present on the container template, the two integer multiples separating different pairs of the parallel fold lines.

It is therefor yet another aspect, advantage, embodiment and objective to provide a container template further comprising: a second unit distance wherein at least two fold lines are separated by the second unit distance, the second unit distance not being equal to any integer multiple of the first unit distance.

It is therefor yet another aspect, advantage, embodiment and objective to provide a container template wherein the first unit distance and integer multiples thereof separates the parallel horizontal lines, and the second unit distance and integer multiples thereof separates the parallel vertical lines.

It is therefor yet another aspect, advantage, embodiment and objective to provide a container template wherein at least of the fold lines is suppressed.

It is therefor yet another aspect, advantage, embodiment and objective to provide a container template wherein perforation line has a density of perforation allowing the user to do to the line one member selected from the group consisting of: folding the perforation line, cutting the perforation line, and combinations thereof.

It is therefor yet another aspect, advantage, embodiment and objective to provide a multi dimensioned easily adjustable single sheet container template for folding into variously dimensioned containers for shipping and storage, the template comprising: a single rectangular sheet of packaging material; the single rectangular sheet having a plurality of vertical fold lines; the single rectangular sheet having a plurality of horizontal fold lines; the single rectangular sheet being divided into a plurality of panels by the vertical and horizontal fold lines; each panel connected to adjoining panels at the fold lines; a plurality of perforation lines, each perforation line extending along at least one side of at least one panel, each perforation line colinear with at least one fold line; wherein each fold line is separated from the next parallel fold line by an integer multiple of a first unit distance, whereby each panel has dimensions which are also an integer multiple of the first unit distance.

It is therefor yet another aspect, advantage, embodiment and objective to provide a multi dimensioned easily adjustable single sheet container template for folding into variously dimensioned containers for shipping and storage, the template comprising: a single rectangular sheet of packaging material; the single rectangular sheet having a plurality of vertical fold lines; the single rectangular sheet having a plurality of horizontal fold lines; the single rectangular sheet being divided into a plurality of panels by the vertical and horizontal fold lines; each panel connected to adjoining panels at the fold lines; a plurality of perforation lines, each perforation line extending along at least one side of at least one panel, each perforation line colinear with at least one fold line; wherein at least one of the plurality of fold lines is to be folded negatively (valley folded).

BRIEF DESCRIPTION OF THE DRAWINGS

FIG. 3A is an end view of one possible container outline after partial construction.

FIG. 3A1 is an orthogonal view of the container dimensions of FIG. 3A at the same stage of construction.

FIG. 3A2 is a front orthogonal view of the container choice of FIG. 3A at the next stage of construction.

FIG. 3A2 is a front orthogonal view of the container choice of FIG. 3A at a still later stage of construction.

FIG. 3A3 is a front orthogonal view of the container choice of FIG. 3A after completion of the container.

FIG. 3B is an end view of a second possible container choice at a preliminary stage of construction.

FIG. 3B1 is a front orthogonal view of the container choice of FIG. 3B at the next stage of construction.

FIG. 3B2 is a front orthogonal view of the container choice of FIG. 3B at a still later stage of construction.

FIG. 3B3 is a front orthogonal view of the container choice of FIG. 3B after completion of the container.

FIG. 3C is an end view of a third possible container choice at a preliminary stage of construction.

FIG. 3C1 is a front orthogonal view of the container choice of FIG. 3C at the next stage of construction.

FIG. 3C2 is a front orthogonal view of the container choice of FIG. 3C at a still later stage of construction.

FIG. 3C3 is a front orthogonal view of the container choice of FIG. 3C after completion of the container.

FIG. 6A is an end view of one possible container outline after partial construction.

FIG. 6A1 is an orthogonal view of the container dimensions of FIG. 6A at the same stage of construction.

FIG. 6A2 is a front orthogonal view of the container choice of FIG. 6A at the next stage of construction.

FIG. 6A2 is a front orthogonal view of the container choice of FIG. 6A at a still later stage of construction.

FIG. 6A3 is a front orthogonal view of the container choice of FIG. 6A after completion of the container.

FIG. 6B is an end view of a second possible container choice at a preliminary stage of construction.

FIG. 6B1 is a front orthogonal view of the container choice of FIG. 6B at the next stage of construction.

FIG. 6B2 is a front orthogonal view of the container choice of FIG. 6B at a still later stage of construction.

FIG. 6B3 is a front orthogonal view of the container choice of FIG. 6B after completion of the container.

FIG. 6C is an end view of a third possible container choice at a preliminary stage of construction.

FIG. 6C1 is a front orthogonal view of the container choice of FIG. 6C at the next stage of construction.

FIG. 6C2 is a front orthogonal view of the container choice of FIG. 6C at a still later stage of construction.

FIG. 6C3 is a front orthogonal view of the container choice of FIG. 6C after completion of the container.

FIG. 6D is an end view of a second possible container choice at a preliminary stage of construction.

FIG. 6D1 is a front orthogonal view of the container choice of FIG. 6D at the next stage of construction.

FIG. 6D2 is a front orthogonal view of the container choice of FIG. 6D at a still later stage of construction.

FIG. 6D3 is a front orthogonal view of the container choice of FIG. 6D after completion of the container.

FIG. 6E is an end view of a third possible container choice at a preliminary stage of construction.

FIG. 6E1 is a front orthogonal view of the container choice of FIG. 6E at the next stage of construction.

FIG. 6E2 is a front orthogonal view of the container choice of FIG. 6E at a still later stage of construction.

FIG. 6E3 is a front orthogonal view of the container choice of FIG. 6E after completion of the container.

INDEX TO REFERENCE NUMERALS

1 FIRST LINE INDICIA
2 SECOND LINE INDICIA
3 THIRD LINE INDICIA
4 FOURTH LINE INDICIA
5 FIFTH LINE INDICIA
6 SIXTH LINE INDICIA
7 SEVENTH LINE INDICIA
8 EIGHTH LINE INDICIA
9 NINTH LINE INDICIA
10 TENTH LINE INDICIA
11 ELEVENTH LINE INDICIA
12' TWELFTH LINE INDICIA
R, R'R" REDUCTION FOLD INDICIA
12 HORIZONTAL FOLD LINE
14 HORIZONTAL FOLD LINE
16 HORIZONTAL FOLD LINE
18 HORIZONTAL FOLD LINE
20 HORIZONTAL FOLD LINE
22 HORIZONTAL FOLD LINE
24 HORIZONTAL FOLD LINE
26 HORIZONTAL FOLD LINE
28 GLUE PANEL
30 VERTICAL FOLD LINE
32 VERTICAL FOLD LINE
34 VERTICAL FOLD LINE
36 VERTICAL FOLD LINE
38 VERTICAL FOLD LINE
40 VERTICAL FOLD LINE
42 VERTICAL FOLD LINE
44 VERTICAL FOLD LINE
46 VERTICAL FOLD LINE
48 VERTICAL FOLD LINE
50 VERTICAL FOLD LINE
52 VERTICAL FOLD LINE
54 VERTICAL FOLD LINE
56 VERTICAL FOLD LINE
58 VERTICAL FOLD LINE
60 VERTICAL FOLD LINE

Key to Diagrams of Box Blanks

The diagrams of the blanks may be better understood with reference to the following key. Note that these indications do not apply to diagrams of the boxes.

Dark lines: Fold lines used in embodiment/blank

Light lines: Fold lines suppressed in embodiment/blank

Dotted lines: Perforated or cut lines extending along fold lines

DETAILED DESCRIPTION

Figure 1:
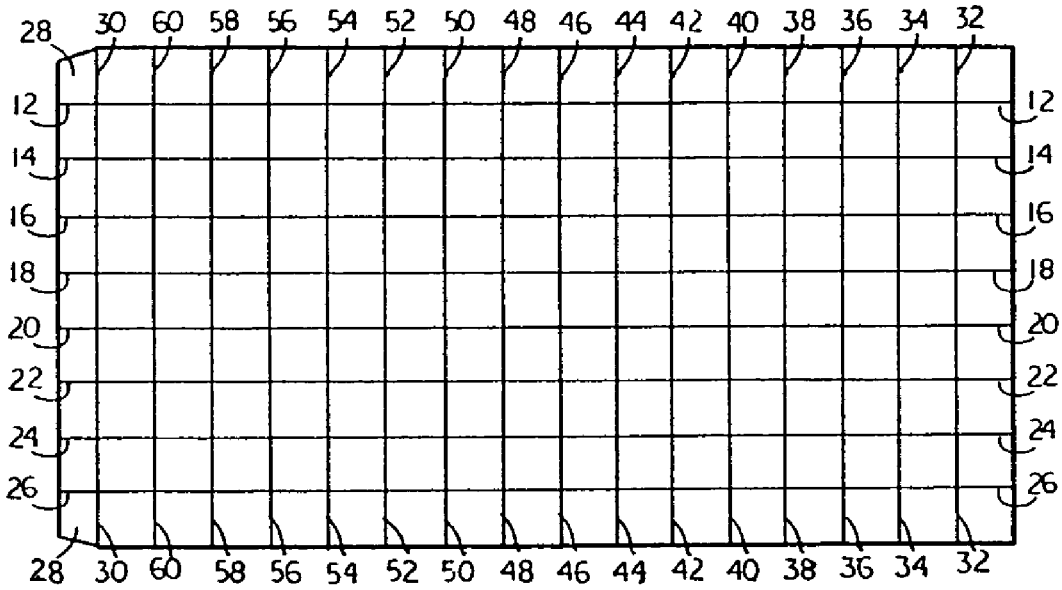
FIG. 1 is a plan view of a first embodiment of the present invention, unfolded and omitting a glue panel.
Figure 1A:
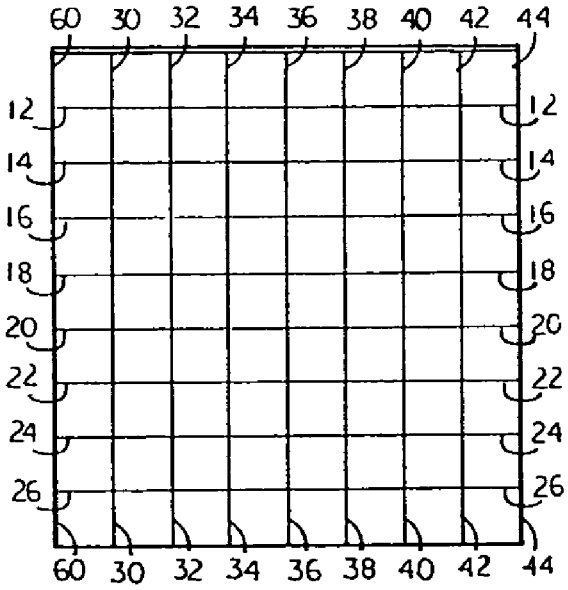
FIG. 1A is a plan view of the first embodiment of the present invention, assembled and glued into a toroidal shape prior to actual use.
Figure 1B:
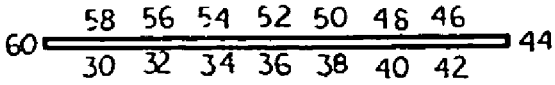
FIG. 1B is an end view of the first embodiment of the present invention, corresponding to the assembled view of FIG. 1A.

FIG. 1 is a plan view of a first embodiment of the present invention, unfolded and omitting a glue panel. The embodiment has horizontal fold lines 12, 14, 16, 18, 20, 22, 24, and 26, and vertical fold lines 30, 32, 34, 36, 38, 38, 40, 42, 44, 46, 48, 50, 54, 56, 58, and 60. Glue panel 28 at the left end is slightly smaller than the remainder of the device, so as to allow easier gluing of the device into its actual use configuration. FIG. 1A is a plan view of the first embodiment of the present invention, assembled and glued into a toroidal shape prior to actual use, and FIG. 1B is an end view of the first embodiment of the present invention, corresponding to the assembled view of FIG. 1A. It may be seen that the template is folded over to create a sleeve shape with the fold lines 30 and 58 on opposite sides thereof, lines 32 and 56 opposing each other and so on. Glue panel 28 is glued onto the back of the other end of the template (that is, the terminal column of panels between vertical fold line 32 and the end of the template) to create the sleeve shape. While fold lines 44 and 60 are the basal fold lines shown which create the sleeve shaped blanks, other choices of lines may of course be used.

The multiple parallel horizontal lines and vertical lines herein create a large number of unit panels of the invention, each of which shows on FIG. 1 as a small square. In addition, a larger group of one row or column of panels may be considered to be a panel, for example, glue panel 28. The dimensions of each unit panel determine the size and shape of the final product (box), as they correspond to the distance between the fold lines. A first unit distance is defined to be the distance by which each fold line is separated from the next parallel fold line, or in alternative embodiments, the separation is by an integer multiple of the first unit distance, whereby each panel has dimensions which are also an integer multiple of the first unit distance.

This integer multiple may be one for every fold line of the container template, whereby each panel has dimensions which are the first unit distance. In other embodiments, there are at least two integer multiples of the first unit distance present on the container template, the two integer multiples separating different pairs of the parallel fold lines. For example, in one embodiment, first and second fold lines may be separated by twice the unit distance, while the second and third fold lines may be separated by three times the unit distance, resulting in a separation which is 50% greater. These multiple integer multiples mean in turn that the unit panels may be of various dimensions and various rectangular shapes within a single blank based upon the template. In yet other embodiments, the first unit distance and integer multiples thereof separate the parallel horizontal lines while the second unit distance and integer multiples thereof separate the parallel vertical lines.

A suppressed fold line, for purposes of this application, is a fold line which has not actually been expressed upon the blank sold to the consumer. Thus, if two lines are a multiple of two (2) unit distances apart, then centered mid-way between them (one (1) unit distance from each) is a third, suppressed, line. The use of such suppressed lines is important to the present invention. By suppressing certain fold or perforation lines, it is possible to dramatically simplify the box blank presented to the consumer. A blank with all of the lines pictured in FIG. 1 actually expressed would be extremely confusing. Eliminating confusion in the mind of the user is the point of the indicia of the present invention, the suppressed fold lines, and other features.

A dimensional example is now provided. One blank which is a version of the template (corresponding to the embodiment discussed at greater length in regard to FIG. 6 et seq) may have a uniform vertical and horizontal unitary distance of 1.5 inches (approximately 3.81 cm). Thus no two parallel fold lines are less than this distance apart, while certain ones are a multiple (2) of this distance and thus three inches apart (approximately 7.62 cm). With appropriate perforation, suppression of unused fold lines, and instructions, this blank or embodiment may produce boxes of the following dimensions (all dimensions in inches): 3×9×8, 4.5×7.5×8, 6×6×8, 3×6×8, and 3×3×8. Obviously, this range of sizes not only cuts down on wasted packing material, it also increases the safety of objects inside. For example, the 6×6×8 size is just slightly larger than an 8 inch stack of audio compact disks in crystal cases, while the 3×3×8 size is ideal for shipping a bottle. Yet both are made from the same blank.

The various multiple container blanks which may be created from the template will now be discussed. Before that discussion, it is important to understand that there are three levels of abstraction in the device and embodiments thereof. At the lowest level, one container or box may be fashioned from the invention by following the appropriate folding procedures, i.e. the 6×6×8 inches box. At the next level up, one blank or embodiment of the present invention may be utilized to form that one box or container, and a set of other related boxes having different dimensions, such as the blank previously discussed.

The highest level, however, the present invention is a template from which a number of different blanks or embodiments may be made. With one set of perforation lines and indicia as to folding procedures, a blank which makes three different boxes may be created. With a different set of perforation lines and indicia, a blank which makes twenty five different boxes may be used.

Figure 2:
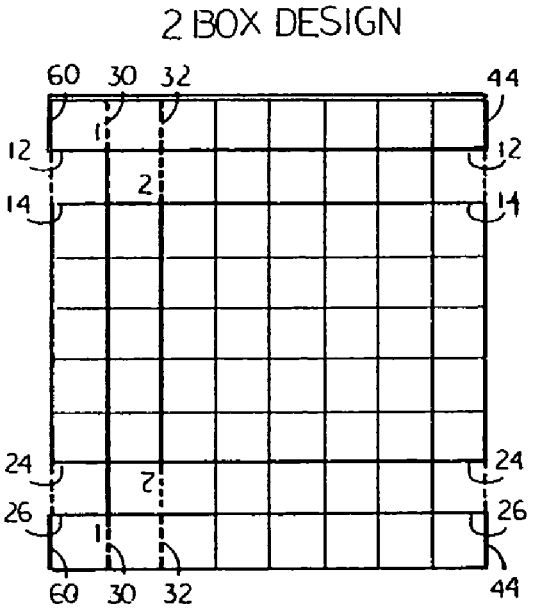
FIG. 2 is a plan view of a second embodiment of the present invention in the proper pre-use shape.

FIG. 2 is a plan view of a second embodiment of the present invention in the proper pre-use shape. This embodiment first shows the use of box shape indicia on the template, and the use (and suppression) of certain fold lines. This embodiment may be used to create two different containers.

Indicia such as are present in the present invention, are shown in FIG. 2. First line indicia 1 and second line indicia 2 are shown self reference numbered. These indicia indicate that for a first container to be fashioned from the embodiment, the fold line 30 is used with the perforations thereon being the basis for cut lines. For a second container to be fashioned from the embodiment, the second container having differing dimensions from the first, fold line 32, indicated by indicia "2".

Perforations (and the cut lines which they allow) shown along vertical fold lines 30 and 32 extend for a unit distance or integer multiple thereof colinearly with the vertical fold line they are located upon. The perforation does not impede folding of the line if necessary, regardless of whether the user has made the perforation into a cut line or left it un-cut. Such folding is normally not necessary, depending upon the embodiment/blank and the user's choice of box to make from that embodiment. Density of perforation refers to the amount of a line which remains present as box material such as cardboard (the spaces between the individual holes or slits of the perforation). A very density of perforation may not allow folding, as folding the perforation line instantly severs the few remaining connections located between the perforations. On the other hand, a low density of perforation allows folding but may make cutting the perforation line rather difficult, as the perforations may be far enough apart to allow tears, cuts or bursts to proceed in any direction rather than neatly along the line. Thus perforation lines of the invention may have a density of perforation allowing the user to do to the line one member selected from the group consisting of: folding the perforation line, cutting the perforation line, and combinations thereof, in embodiments in which a given perforation line may serve either purpose. In other embodiments in which one single perforation line has only a single purpose, the density of perforation may be higher or lower.

Suppression of fold lines is useful in going from the overall template to a given embodiment or blank. As seen in FIG. 2, the lighter fold lines may be omitted from the blank or crimped to a smaller depth (by means of a die having lesser or no protrusion along those lines). Thus the final blank presented to the end user will have fold lines 30 and 32, 60 and 44, 12 and 14, and 24 and 26, along with indicia 1 and 2 and perforations extending partially along fold lines 30 and 32. This minimizes confusion on the part of the end user.

Figure 4:
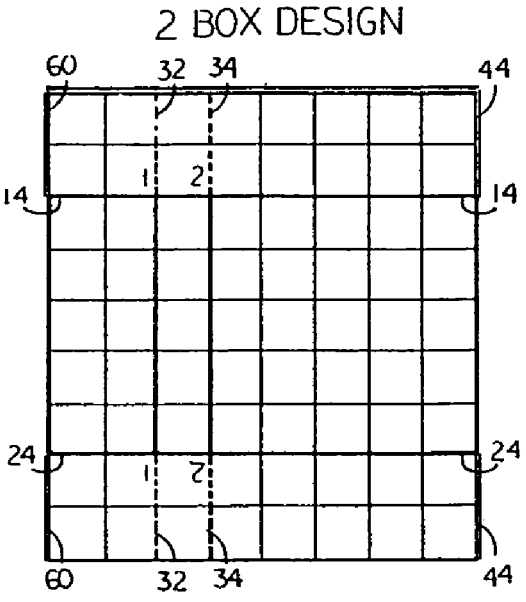
FIG. 4 is a plan view of a fourth embodiment of the present invention.

The template nature of the device may be seen by comparison of FIGS. 2 and 4. FIG. 4 is a plan view of a fourth embodiment of the present invention. This embodiment also may be used to make 2 different box sizes, however, one of the boxes made is different from a box made in the second embodiment of the invention, due to different use of the underlying template: different fold lines are suppressed and used, the indicia of containers are re-positioned appropriately, perforations/cuts are of different length and location and so on.

Figure 3:
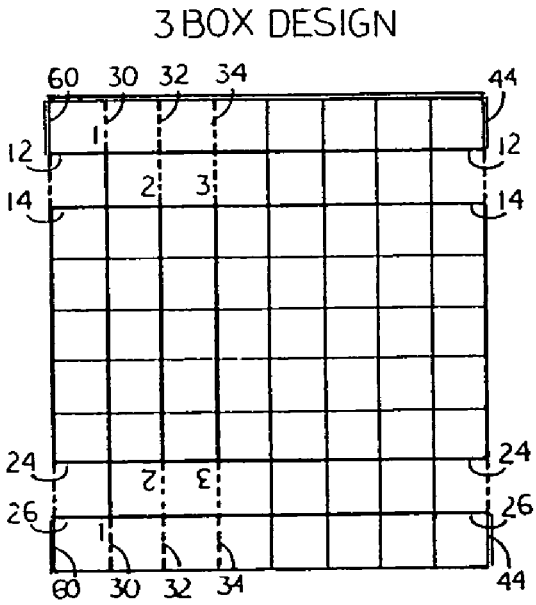
FIG. 3 is a plan view of a third embodiment of the present invention in the proper pre-use shape. The third embodiment is one presently preferred embodiment.

FIG. 3 is a plan view of a third embodiment of the present invention in the proper pre-use shape. The third embodiment is one presently preferred embodiment. This embodiment has indicia, perforations for cut lines, and suppressed fold lines sufficient to allow creation of three boxes of three dimensions. Vertical fold lines 30, 32 and 34 are used (along with their invisible complements on the far side of the container 46, 48 and 50) and lines 44 and 60) and horizontal fold lines 12, 14, 24 and 26. Perforated lines (for cut lines) extend for unit distances or multiples thereof along fold lines 30, 32 and 34 (and complements). Indicia 1, 2 and 3 show how to make the three boxes of this embodiment of the invention.

FIG. 3A is an end view of one possible container outline after partial construction and FIG. 3A1 is an orthogonal view of the container dimensions of FIG. 3A at the same stage of construction. This container is fairly flat (1 unit in depth) but quite broad (7 units in length). If used with a 1 inch unit, the box made would be 1×7 inches, while if a 2 inch unit is used, the final box is 2×14 inches: both sizes will fall within the same embodiment. Folding of this container is shown in the sequence FIG. 3A1, FIG. 3A2 (a front orthogonal view of the container at the next stage of construction) and FIG. 3A2 (a still later stage of construction).

FIG. 3A3 is a front orthogonal view of the container choice of FIG. 3A after completion of the container.

FIG. 3B is an end view of a second possible container choice at a preliminary stage of construction. This choice of dimension will be twice as deep but only 6 units in width. Again, folding is shown in the sequence of FIG. 3B1, FIG. 3B2, and finally FIG. 3B3 after completion of the container. It will be appreciated that while such folding appears simple, in practice by a user having only limited familiarity with the invention template, it is helpful to provide indicia 1, 2 and 3, and possibly additional indicia as well.

FIG. 3C is an end view of a third possible container choice at a preliminary stage of construction, and FIG. 3C1, FIG. 3C2 and FIG. 3C3 show the steps to completion of the container.

Comparison of the three boxes shown above will reveal that the first choice involved cutting and folding along the perforation indicated by indicia "1", while the second container required cutting and folding along the perforation indicated by indicia "2" and the final one required cutting and folding along the perforation and fold line indicated by indicia "3".

Such choices and proper folding may be greatly simplified by the suppression of unused fold lines from the template. Thus in practice, only lines 30, 32 and 34, 44, 46, 48, 50 and 60 may be provided in the vertical direction and lines 12, 14, 24 and 26 in the horizontal direction.

Another method of increasing speed and accuracy of folding by the end users is to include further indicia of folding properly. An alternative indicia may be used such as lettering like "A" or "Fold here first". In certain embodiments, reducing folds are indicated by the indicator "R". Since the template is folded and glued into a sleeve configuration prior to the end user, the normal folds utilized are all "mountain" folds or positive folds in which the fold line comes up while the materials on each side are go down as the fold progresses. However, certain smaller boxes may be created using one or more reducing folds which double up portions of the blank. Such folds are "valley folds" or negative folds in which the fold line is depressed down while the material on each side rises up as the fold progresses.

Figure 10:
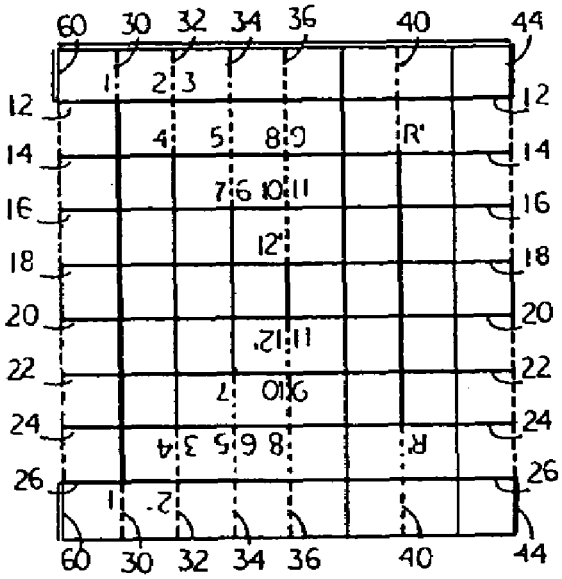
FIG. 10 is a plan view of a tenth embodiment of the present invention, a 14 container template.

Other indicia possible include instructions indicating the steps to take to fold the container template into each of the plurality of differently dimensioned containers, such as "Step one: fold along the line numbered 1". For certain users, diagrams indicating the steps to take to fold the container template into each of the plurality of differently dimensioned containers may be more useful. The indicia may further provide instruction as to the length of a given perforation line/cut line which is to be cut at the time of folding, though in the presently preferred embodiments, this is not favored: instead, the perforation runs the proper length for use in folding a given container from a given blank/embodiment of the template. When indicia of length is provided, it may be provided by the following device: a given perforation line may have different indicia along its length. For example, FIG. 10 shows fold line 36 with indicia 8, 9, 10, 11 and 12 along its length at three different locations. By cutting the perforation to that indicia but no further, the proper folds may be assured. Thus one perforation line may become more than a single choice of cut line, unlike prior art.

In the presently preferred embodiments, the indicia provide instructions for folding and cutting/perforating based upon the box dimensions of the final box to be produced. So a diagram and/or statement such as "3×9×8" may be printed upon the blank to aid in selection of choice of box to be folded from a given blank.

Figure 5:
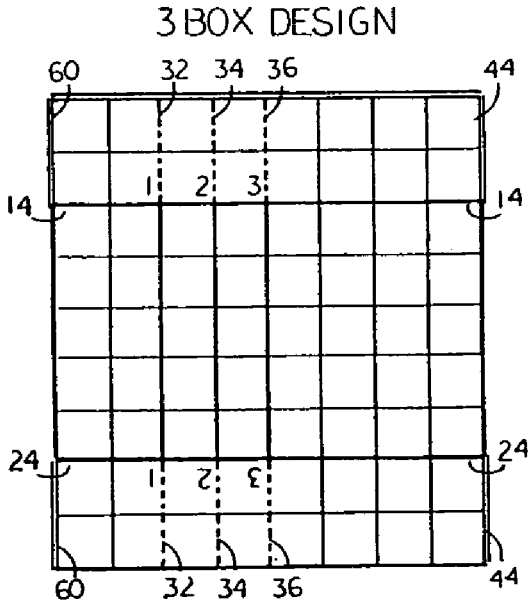
FIG. 5 is a plan view of a fifth embodiment of the present invention.

FIG. 5 is a plan view of a fifth embodiment of the present invention. This embodiment is also a three box design, but with an overlapping but different selection of possible containers. While the previous embodiment of (FIG. 3 et seq) uses vertical fold lines 30, 32 and 34, (among others) this embodiment uses lines 32, 34 and 36 and thus can be used to fold some of the same dimensions of box but also folds at least one box of differing dimensions.

Figure 6:
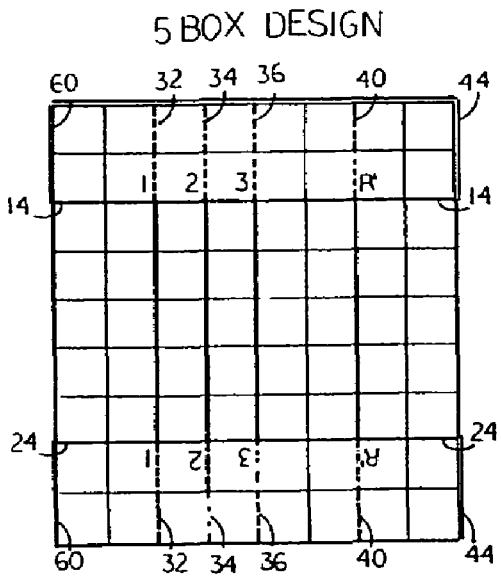
FIG. 6 is a plan view of a sixth embodiment of the present invention, a five container design which is presently the most preferred embodiment and best mode now contemplated for carrying out the invention.

FIG. 6 is a plan view of a sixth embodiment of the present invention, a five container design which is presently the most preferred embodiment and best mode now contemplated for carrying out the invention. This embodiment uses indicia 1, 2, 3 and (for reducing or negative folds as discussed previously) positioned along fold lines 32, 34, 36 and 40 in addition to basal fold lines 60 and 44, and the complementary fold lines to 32, 34, 36 and 40 (48, 50, 52 and 56) which are not seen due to being on the back side of the device (see FIG. 2—complementary fold lines are not directly behind the fold lines shown but are rather the same number of units from the opposite basal fold line).

Sequences of folding operations are once again shown.

FIG. 6A is an end view of one possible container outline after partial construction. FIG. 6A1 is an orthogonal view of the container dimensions of FIG. 6A at the same stage of construction. FIG. 6A2 depicts the next stage of construction and FIG. 6A3 is a front orthogonal view of the container choice of FIG. 6A after completion of the container.

FIG. 6B is an end view of a second possible container choice at a preliminary stage of construction. FIG. 6B1, FIG. 6B2 and FIG. 6B3 show the steps until completion of the container.

FIG. 6C is an end view of a third possible container choice at a preliminary stage of construction. Again, FIGS. 6C1 and 6C2 and 6C3 depict various stages of construction and completion.

FIG. 6D is an end view of a second possible container choice at a preliminary stage of construction. FIG. 6D1, FIG. 6D2, FIG. 6D3 all show the progression of folding to achieve the container desired.

FIG. 6E is an end view of a third possible container choice at a preliminary stage of construction. FIG. 6E1, FIG. 6E2, and FIG. 6E3 show folding into container shape. This blank or embodiment may produce boxes of the following dimensions (all dimensions in inches): 3×9×8, 4.5×7.5×8, 6×6×8, 3×6×8, and 3×3×8. This is the embodiment discussed as an example of unit lengths previously.

This particular blank may be created by suppressing vertical fold lines as follows: fold lines 30, 38, 42 and complements on the backside, as well as horizontal fold lines 12, 16, 18, 20, 22, and 26. Perforations are extended along vertical fold lines 32, 34, 36 and 40 (and complements) for two unit lengths for the proper folding sizes.

Obviously, the end user may be sold either of two different devices. Firstly, the end user may be sold the actual template, along with instructions for perforation and folding. In effect the end user is thus able to fold a very large number of boxes. Secondly, the end user may be sold not templates but rather blanks having properly suppressed fold lines, indicia and so on. This general approach is the favored embodiment at the present time, as the end user is likely to be unable to cope with the great number of containers otherwise offered. In this mode, the indicia will include indications of the end dimensions of the various containers which can be folded from a single blank. The end user then chooses between a small number of blanks of various types and sizes to select the one which has as an option folding the desired box. In commerce, a store owner able to stock only a dozen sizes of blanks would under the prior art be restricted to selling a dozen sizes of boxes. Using the device of the present invention with various unit distances and various embodiments, a dozen blanks could allow sales of fifty or more different box sizes.

Figure 7:
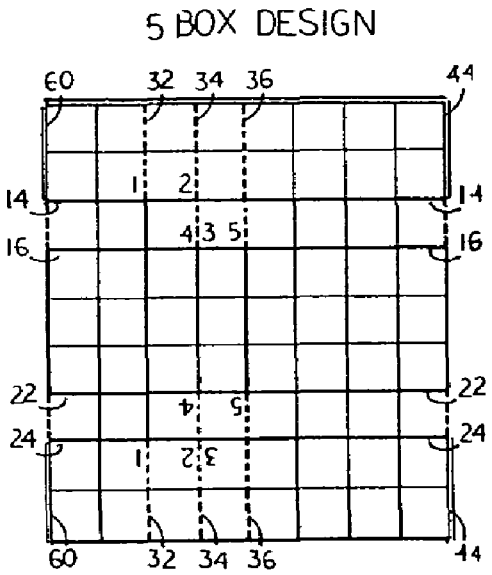
FIG. 7 is a plan view of a seventh embodiment of the present invention.
Figure 8:
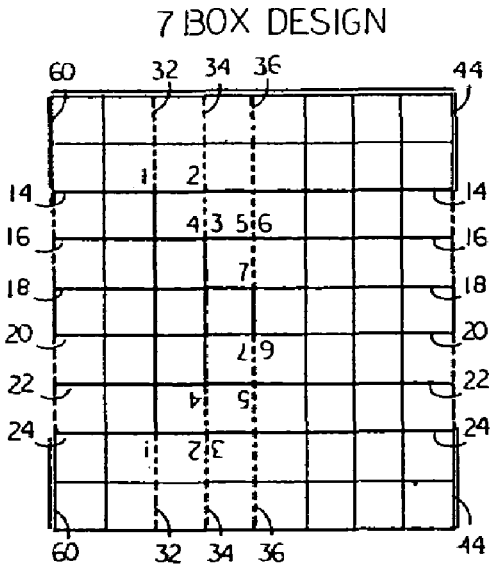
FIG. 8 is a plan view of an eighth embodiment of the present invention.
Figure 9:
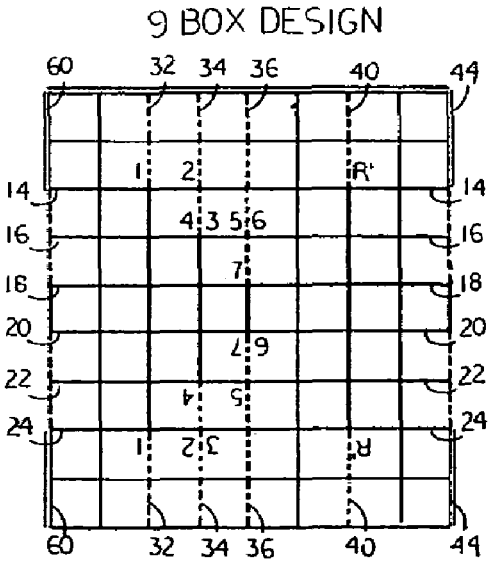
FIG. 9 is a plan view of a ninth embodiment of the present invention.

FIG. 7 is a plan view of a seventh embodiment of the present invention, having folding lines, suppressed lines, perforations and indicia allowing folding of five different boxes. FIG. 8 is a plan view of an eighth embodiment of the present invention, allowing folding of seven different boxes, while FIG. 9 is a plan view of a ninth embodiment of the present invention which uses reduction folding at indicia to allow folding of considerably more containers that the eighth embodiment of FIG. 8, even though the actual positive fold lines and perforations are identical other than the reduction fold.

Figure 11:
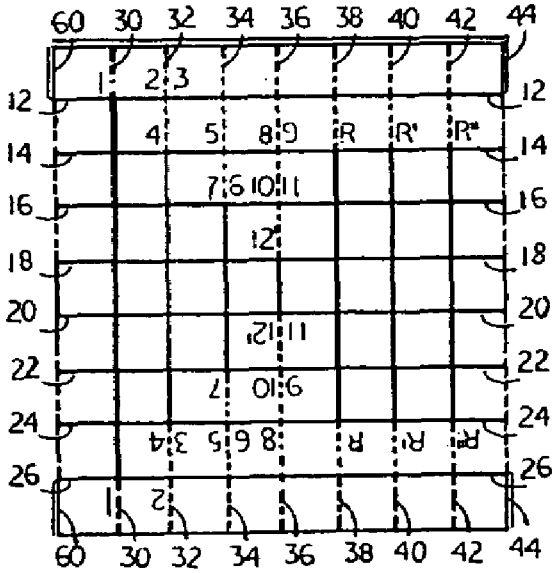
FIG. 11 is a plan view of an eleventh embodiment of the present invention, a 25 container template.

FIG. 10 is a plan view of a tenth embodiment of the present invention, a 14 container blank of the template. FIG. 11 is a plan view of an eleventh embodiment of the present invention, a 25 container embodiment of the underlying template.

Figure 11A:
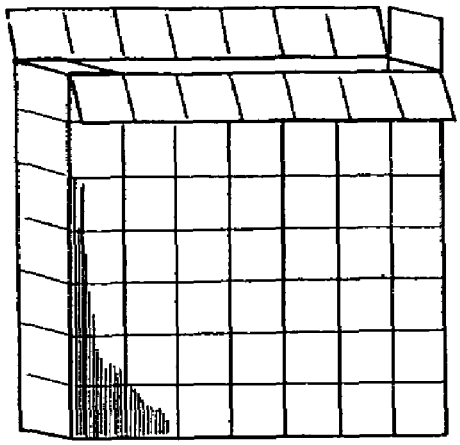
FIG. 11A is a front orthogonal view of one possible choice of container made from the eleventh embodiment of the invention.
Figure 11B:
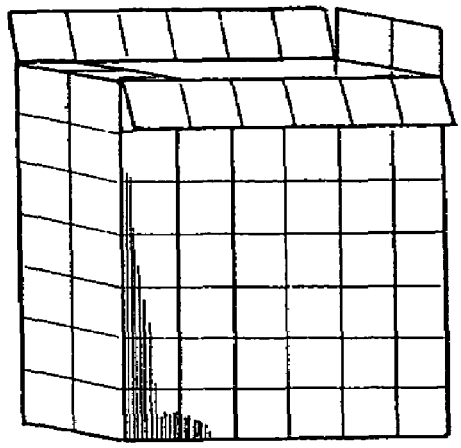
FIG. 11B is a front orthogonal view of another possible choice of container made from the eleventh embodiment of the invention.
Figure 11C:
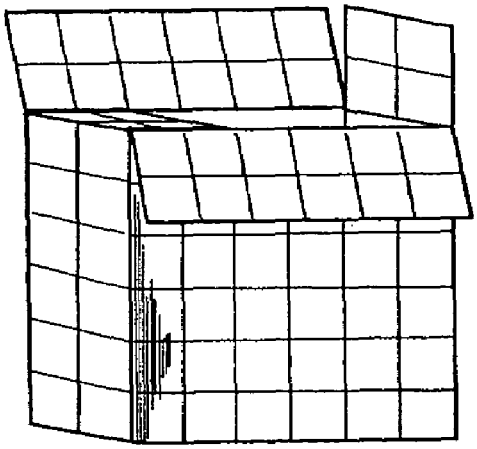
FIG. 11C is a front orthogonal view of another possible choice of container made from the eleventh embodiment of the invention.
Figure 11D:
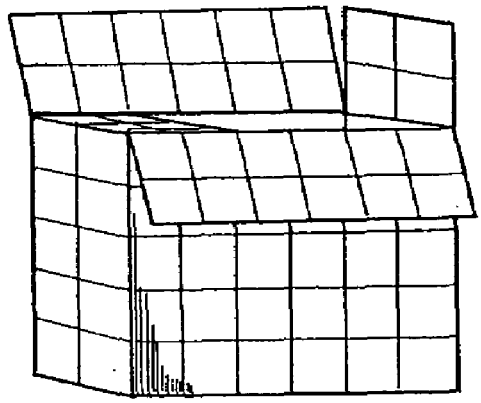
FIG. 11D is a front orthogonal view of another possible choice of container made from the eleventh embodiment of the invention.
Figure 11E:
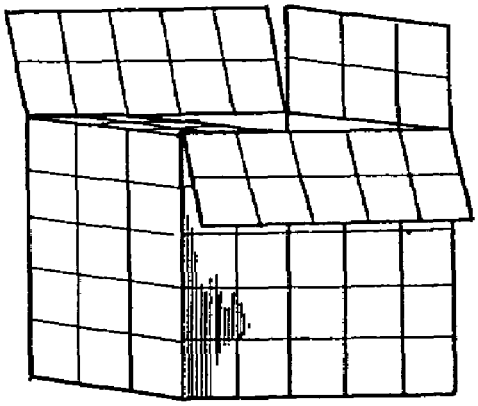
FIG. 11E is a front orthogonal view of another possible choice of container made from the eleventh embodiment of the invention.

The measurements in the next paragraph are dimensionless units. FIG. 11A is a front orthogonal view of one possible choice of container made from the eleventh embodiment of the invention, having unit dimensions of 7×1×7. FIG. 11B is a front orthogonal view of another possible choice of container made from the eleventh embodiment of the invention, this one is 7 units by 2 units by 6 units. FIG. 11C is a front orthogonal view of another possible choice of container which is 6×2×6, FIG. 11D is container sized 5×2×6, FIG. 11E depicts a container made from the eleventh embodiment of the invention and of size 5×3×5. The following container choices are referred to by Figure number and dimensions as units, in order avoid prolixity.

Figure 11F:
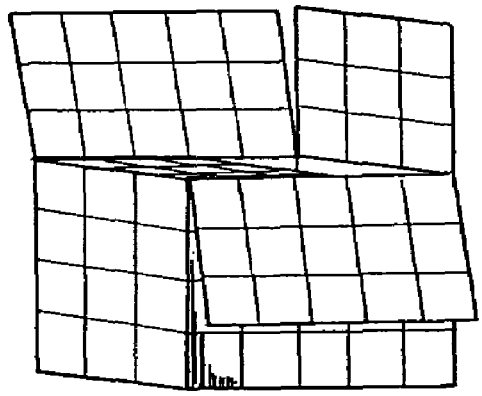
FIG. 11F is a front orthogonal view of another possible choice of container made from the eleventh embodiment of the invention.
Figure 11G:
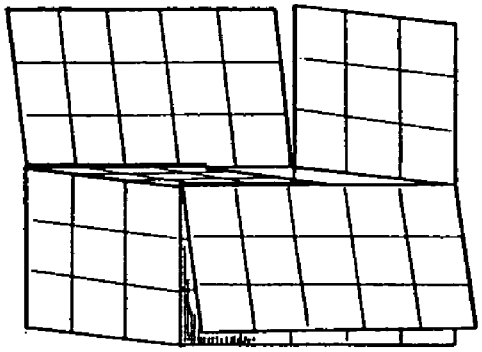
FIG. 11G is a front orthogonal view of another possible choice of container made from the eleventh embodiment of the invention.
Figure 11H:
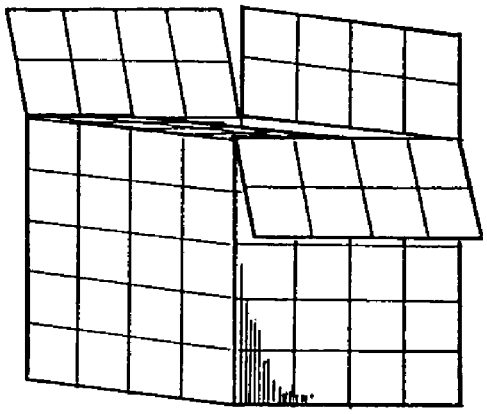
FIG. 11H is a front orthogonal view of another possible choice of container made from the eleventh embodiment of the invention.
Figure 11I:
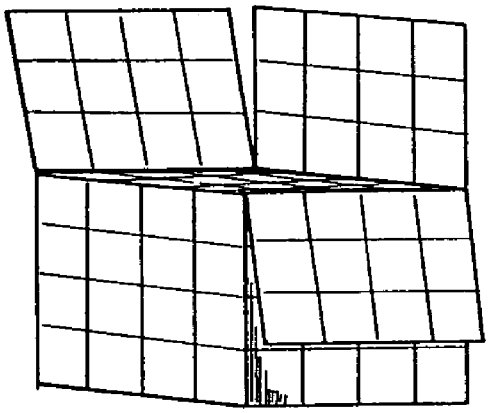
FIG. 11I is a front orthogonal view of another possible choice of container made from the eleventh embodiment of the invention.
Figure 11J:
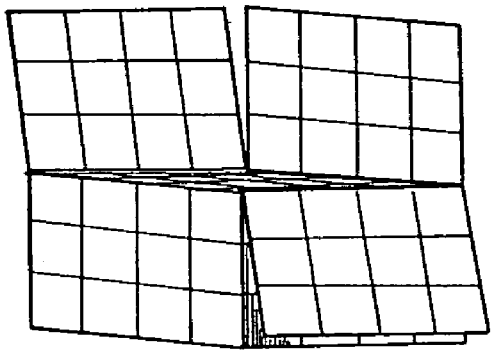
FIG. 11J is a front orthogonal view of another possible choice of container made from the eleventh embodiment of the invention.
Figure 11K:
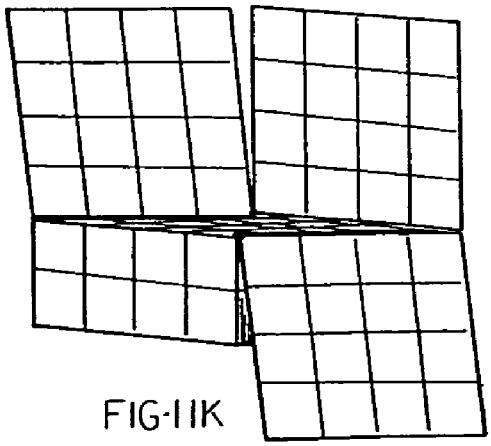
FIG. 11K is a front orthogonal view of another possible choice of container made from the eleventh embodiment of the invention.
Figure 11L:
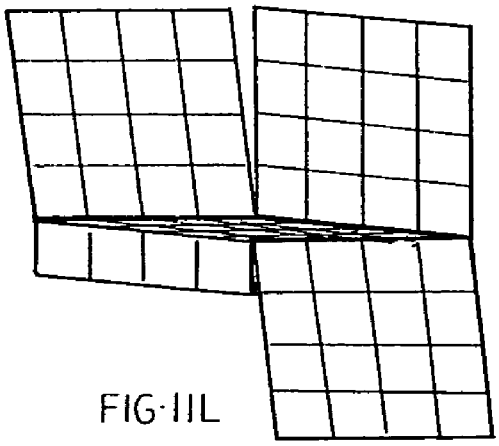
FIG. 11L is a front orthogonal view of another possible choice of container made from the eleventh embodiment of the invention.
Figure 11M:
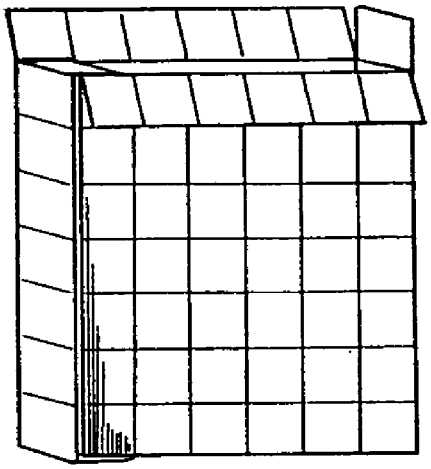
FIG. 11M is a front orthogonal view of another possible choice of container made from the eleventh embodiment of the invention.
Figure 11N:
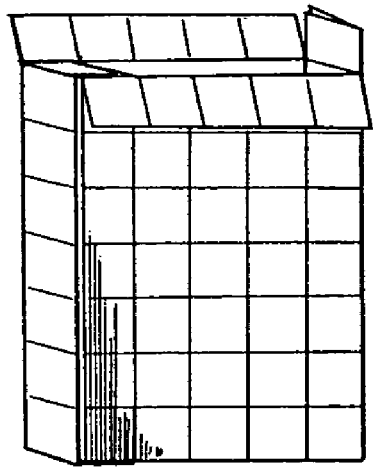
FIG. 11N is a front orthogonal view of another possible choice of container made from the eleventh embodiment of the invention.
Figure 11O:
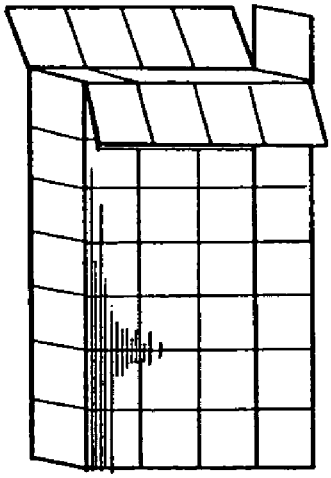
FIG. 11O is a front orthogonal view of another possible choice of container made from the eleventh embodiment of the invention.
Figure 11P:
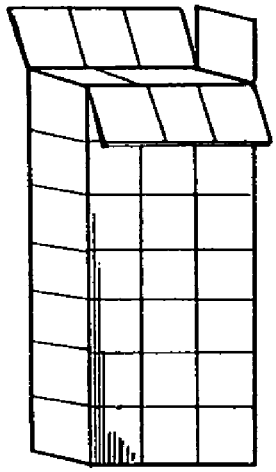
FIG. 11P is a front orthogonal view of another possible choice of container made from the eleventh embodiment of the invention.
Figure 11Q:
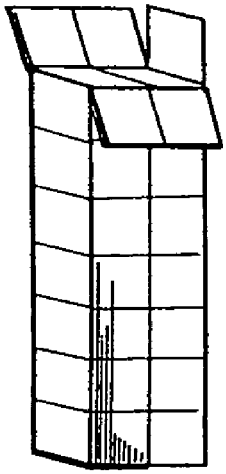
FIG. 11Q is a front orthogonal view of another possible choice of container made from the eleventh embodiment of the invention.
Figure 11R:
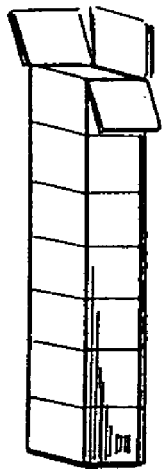
FIG. 11R is a front orthogonal view of another possible choice of container made from the eleventh embodiment of the invention.
Figure 11S:
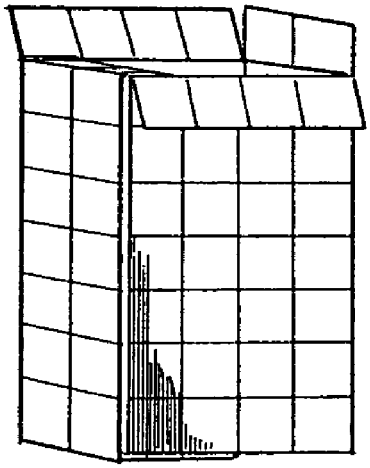
FIG. 11S is a front orthogonal view of another possible choice of container made from the eleventh embodiment of the invention.
Figure 11T:
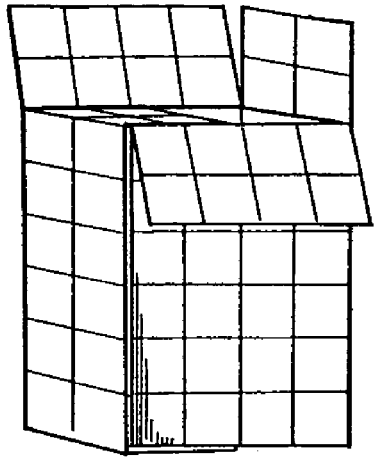
FIG. 11T is a front orthogonal view of another possible choice of container made from the eleventh embodiment of the invention.
Figure 11U:
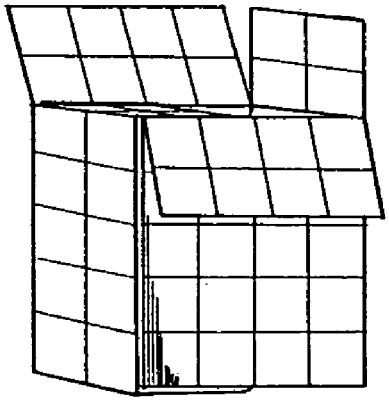
FIG. 11U is a front orthogonal view of another possible choice of container made from the eleventh embodiment of the invention.
Figure 11V:
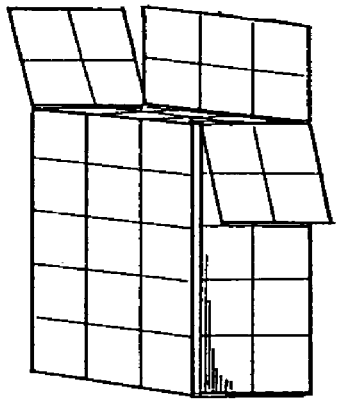
FIG. 11V is a front orthogonal view of another possible choice of container made from the eleventh embodiment of the invention.
Figure 11W:
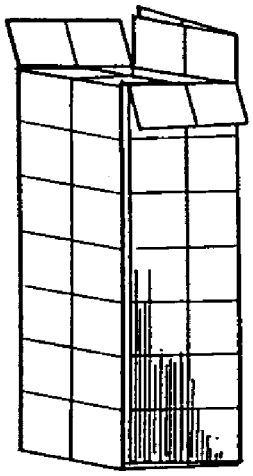
FIG. 11W is a front orthogonal view of another possible choice of container made from eleventh embodiment of the invention.
Figure 11X:
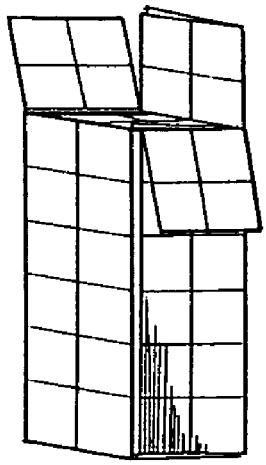
FIG. 11X is a front orthogonal view of another possible choice of container made from the eleventh embodiment of the invention.
Figure 11Y:
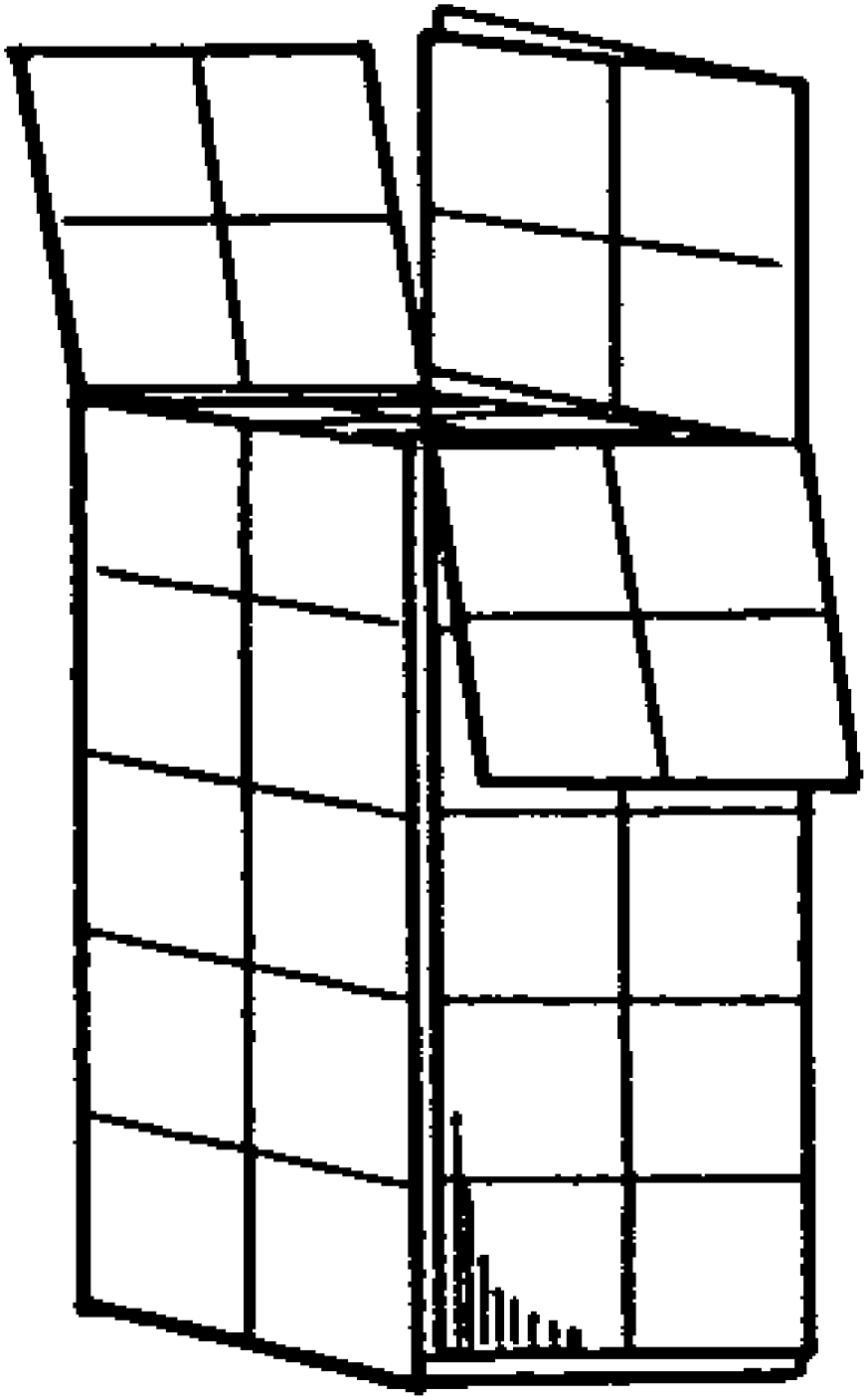
FIG. 11Y is a front orthogonal view of another possible choice of container made from the eleventh embodiment of the invention.

FIG. 11F: is 4×3×5, FIG. 11G: 3×3×5, FIG. 11H: 5×4×4, FIG. 11I: 4×4×4, FIG. 11J: 3×4×4, FIG. 11K: 2×4×4, FIG. 11L: 1×4×4, FIG. 11M: 1×6×6, FIG. 11N: 1×6×5, FIG. 11O: 1×6×4, FIG. 11P: 1×6×3, FIG. 11Q: 1×6×2, FIG. 11R: 1×6×1, FIG. 11S: 2×7×4, FIG. 11T: 2×6×4, FIG. 11U: 2×5×4, FIG. 11V: 3×2×4, FIG. 11W: 2×7×2, FIG. 11X: 2×6×2, FIG. 11Y: 2×5×2. It will be seen that each combination of unit dimensions is unique within this list.

It will be obvious that these numerous containers present varied options to the user. For example, the choice shown in FIG. 11I is a cubical shape in embodiments in which the horizontal and vertical unit measurements are the same. Such a shape is advantageous for some users and applications, while the embodiment of FIG. 11R is a single unit in width and depth, and uses the reducing or valley fold lines (R, R', R") to achieve this, thus also strengthening the final box.

Thus, in the preferred embodiment of the template invention herein, indicia are used. Even with a blank/embodiment having as few as three or five shapes, confusion may result as the user determines their preferred or needed dimensions. Thus the indicia of the invention are important (as seen in claim 1) in aiding users to actually make use of the full range of mathematically allowed possibilities.

Choice of material is not crucial to use of the invention, so long as it is sturdy but flexible. The material of the container template may be one member selected from the group consisting of: single ply cardboard, multi-ply cardboard, corrugated cardboard, polymer, metal, composite materials, and combinations thereof. At the present time, corrugated cardboard is preferred.

Indicia may be placed upon the device by several means: impression into the cardboard, printing, decals, adhesion, impression, weaving and so on, with printing the obviously preferred choice.

There is no functional limitation on height or width of the invention other than the natural limitations of all boxes: crush strength, burst strength, legal limitations and commercial considerations. One very important method of creating yet more alternative embodiments of the invention is the addition of units, as the invention may have a basic formula/template of numerous sizes other than the 9 unit by 15 unit embodiment shown in these diagrams. Size variations may also be achieved in several ways: increasing or decreasing the unit distance, increasing or decreasing the integer multiples of the unit distance, using more than one unit distance, using different unit distances for the horizontal fold line and vertical line separations, adding or removing unit panels and fold lines from the device and so on. Boxes in a size and dimension range which is literally unlimited may be produced within the bounds of the present invention. Suppressed lines may also be omitted, for example in one embodiment, all units are expressed individually, with no units grouped by any suppressed lines.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the claims accompanying this utility application.

We claim:

1. A multi dimensioned easily adjustable single sheet container template with indicia for folding into a container having one of a plurality of different dimensions, the template comprising:

a single substantially rectangular sheet of packaging material;

the single rectangular sheet having a plurality of parallel vertical fold lines;

the single rectangular sheet having a plurality of parallel horizontal fold lines;

the single rectangular sheet being divided into a plurality of panels by the vertical and horizontal fold lines;

a plurality of perforation lines, each of the perforation lines extending along at least one side of at least one of the panels, each of the perforation lines colinear with at least one of the fold lines;

first and second unit distances, the second unit distance not equal to any integer multiple of the first unit distance, wherein parallel fold lines are separated by an integer multiple of the unit distances, wherein at least two fold lines are separated by the first unit distance and at least two fold lines are separated by the second unit distance, whereby the panels have dimensions which are also an integer multiple of the unit distances;

1) a first set of indicia of a first subset of the plurality of fold lines and perforation lines, the single rectangular sheet when folded and cut according to the first set of indicia becoming the container having a first one of a plurality of different dimensions; and 2) a second set of indicia of a second subset of the plurality of fold lines and perforation lines, the single rectangular sheet when folded and cut according to the second set of indicia becoming the container and having a second one of the plurality of different dimensions.

2. The container template of claim 1, further comprising: third, fourth and fifth sets of indicia allowing folding and cutting into respective third fourth and fifth different dimensions of containers.

3. The container template of claim 2, further comprising: sixth through fifteenth sets of indicia allowing folding and cutting into respective sixth through twenty-fifth different dimensions of containers.

4. The container template of claim 1, wherein the indicia further comprise:

numbered designators of each of the plurality of fold lines and perforation lines.

5. The container template of claim 1, wherein the indicia further comprise:

lettered designators of each of the plurality of fold lines and perforation lines.

6. The container template of claim 4, wherein the indicia further comprise:

instructions indicating a set of steps to take to fold the container template into each of the plurality of differently dimensioned containers.

7. The container template of claim 1, wherein the indicia further comprise: diagrams indicating the steps to take to fold the container template into each of the plurality of differently dimensioned containers.

8. The container template of claim 1, wherein the indicia further provide instruction as to the length of at least one of the perforation lines which is to be cut at a time of folding.

9. The container template of claim 1, wherein the indicia further provide dimensions of the container to be produced and further wherein the indicia provide instructions for folding and cutting based upon the dimensions of the container to be produced.

10. The container template of claim 1, wherein the material of the container template is one member selected from the group consisting of: single ply cardboard, multi-ply cardboard, corrugated cardboard, polymer, metal, composite materials, and combinations thereof.

11. The container template of claim 1, wherein the integer multiple is one for every fold line of the container template, whereby each panel has dimensions which are the first unit distance.

12. The container template of claim 1, wherein there are at least two integer multiples of the first unit distance present on the container template, the two integer multiples separating different pairs of the parallel fold lines.

13. The container template of claim 1, wherein the first unit distance and integer multiples thereof separates the parallel horizontal fold lines, and the second unit distance and integer multiples thereof separates the parallel vertical fold lines.

14. The container template of claim 1, wherein at least one perforation line has a density of perforation allowing the user to do to the line one member selected by the user at a time of folding from the group consisting of: folding the perforation line, cutting the perforation line, and combination thereof.

15. A multi dimensioned easily adjustable single sheet container template for folding into a container having one of a plurality of different dimensions, the template comprising:

a single substantially rectangular sheet of packaging material;

the single rectangular sheet having at least 16 parallel vertical fold lines;

the single rectangular sheet having at least 8 parallel horizontal fold lines;

the single rectangular sheet being divided into a plurality of panels by the vertical and horizontal fold lines;

a plurality of perforation lines, each of the perforation lines extending along at least one side of at least one of the panels, each of the perforation lines colinear with at least one of the fold lines;

first and second unit distances, the second unit distance not equal to any integer multiple of the first unit distance, wherein parallel fold lines are separated by an integer multiple of the unit distances, wherein at least two fold lines are separated by the first unit distance and at least two fold lines are separated by the second unit distance, whereby the panels have dimensions which are also an integer multiple of the unit distances.

* * * * *